US006815666B2

(12) United States Patent
Schroeder et al.

(10) Patent No.: US 6,815,666 B2
(45) Date of Patent: Nov. 9, 2004

(54) SINGLE STAGE ACCELERATOR MASS SPECTROMETER

(75) Inventors: James B. Schroeder, Madison, WI (US); James A. Ferry, Middleton, MI (US)

(73) Assignee: National Electrostatics Corp., Middleton, WI (US)

( * ) Notice: Subject to any disclaimer, the term of this patent is extended or adjusted under 35 U.S.C. 154(b) by 0 days.

(21) Appl. No.: 10/236,330

(22) Filed: Sep. 6, 2002

(65) Prior Publication Data

US 2004/0046116 A1 Mar. 11, 2004

(51) Int. Cl.[7] ..... H01J 49/32; H01J 49/26

(52) U.S. Cl. ..... 250/281; 250/282; 250/296; 250/298

(58) Field of Search ..... 250/281–282, 250/296, 298, 398

(56) References Cited

U.S. PATENT DOCUMENTS

| | | | | |
|---|---|---|---|---|
| 4,037,100 A | | 7/1977 | Purser | |
| 4,973,841 A | | 11/1990 | Purser | |
| 5,291,909 A | * | 3/1994 | Skorman et al. | 135/67 |
| 5,313,061 A | | 5/1994 | Drew et al. | |
| 5,438,205 A | | 8/1995 | Schroeder | |
| 5,534,699 A | | 7/1996 | Ferry | |
| 5,621,209 A | * | 4/1997 | Purser | 250/296 |
| 5,631,526 A | | 5/1997 | Ferry | |
| 5,644,130 A | | 7/1997 | Raatz | |
| 5,661,299 A | * | 8/1997 | Purser | 250/281 |

OTHER PUBLICATIONS

Accelerator Mass Spectrometer, AMS Systems, http://www.pelletron.com/amsop.htm, 3 pages, *prior art*.

"New Developments in Design and Applications for Pelletron Accelerators", G.A. Norton, National Electrostatics Corp., Middleton, Wisconsin, *prior art*.

* cited by examiner

*Primary Examiner*—Nikita Wells
*Assistant Examiner*—Christopher M. Kalivoda
(74) *Attorney, Agent, or Firm*—Lathrop & Clark LLP

(57) ABSTRACT

A negative ion source placed inside a negatively-charged high voltage electrode emits a beam which is accelerated to moderate energy, approximately 35,000 electron volts, and filtered by a momentum analyzer i.e. an analyzing bending magnet, to remove unwanted ions. Reference ions such as carbon-12 are deflected and measured in an off-axis Faraday cup. Ions of interest, such as carbon ions of mass 14, are accelerated through 300 kV to ground potential and passed through a gas stripper where the ions undergo charge exchange and molecular destruction. The desired isotope, carbon-14 along with fragments of the interfering molecular ions, emerge from the stripper into a momentum analyzer which removes undesirable isotope ions. The ions are further filtered by passing through an electrostatic spherical analyzer to remove ions which have undergone charge exchange. The ions remaining after the spherical analyzer are transmitted to a detector and counted.

39 Claims, 5 Drawing Sheets

SINGLE STAGE ACCELERATOR MASS SPECTROMETER

CROSS REFERENCES TO RELATED APPLICATIONS

Not applicable.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to electrostatic accelerators in general and to the use of electrostaic accelerators to perform accelerator mass spectrometry in particular.

Since the late 1970's techniques have been developed for using tandem electrostatic accelerators to develop extremely sensitive mass spectrometers able to distinguish the presence of atomic isotopic ratios as small as $10^{-15}$, for example between carbon-12 and carbon-14. The detection of very small quantities of isotopes from samples of less than 1 mg has revolutionized the process of carbon dating. The ability to uniquely detect the presence of atomic isotopes finds many uses, for example, carbon dating, or using atomic isotopes as chemical labels. The use of long-lived radioactive compounds as labels forms an important subset of the possible uses to which accelerator mass spectrometry (AMS) can be employed. Radioactive isotopes with long half-lives are difficult to measure by detection of radioactive decay if the sample size is small and the half-life of the radioactive isotope is large. For radioactive carbon-14, with a half-life of 5,730 years, a sample size of one gram is generally considered necessary for radioactive carbon dating. A one-gram sample of modern carbon contains approximately $10^{-12}$ grams $^{14}C$ or approximately $5\times10^{10}$ atoms of $^{14}C$ and produces only 14 disintegrations per minute. Using an accelerator mass spectrometer (AMS) as much as 10 percent of the atoms of $^{14}C$ present in a sample can be directly detected. The result is that the concentration of carbon-14 can be measured with a precision of better than one percent in a modern sample, using a sample size of less than one mg in only a few minutes.

Mass spectrometry uses the principal that a charged particle is deflected more or less by a magnetic or static electric field depending on the velocity and mass of the particle. By the proper combination of magnetic and/or electrostatic analyzers it is possible to separate particles by mass and velocity and thus to detect the mass and energy of individual particles. The detection of a particular atomic isotope, however, requires for unique detection that all molecular isobars be eliminated. For example, in the case of carbon-14 molecular isobars of $^{13}CH$ and $^{12}CH_2$ are perhaps one million times more prevalent than the carbon-14 to be measured. To detect carbon-14, negatively charged particles of mass 14 are accelerated in the tandem accelerator through a potential of about one-half million volts to several million volts. The negatively charged particles of mass 14 are passed through a stripping column of rarefied gas in the high voltage positively charged electrode. The stripping column causes the particles to lose electrons and in the process breaks up any molecular isobars into their constituent parts. The positively charged ions are accelerated away from the positively charged high voltage electrode to ground and the particles of mass 14 are separated and counted.

Although very successful accelerator mass spectrometers (AMS) are relatively expensive and of large size, and have certain operation requirements such as the handling of sulfur hexafluoride insulating gas which contribute to the expensive operation. A smaller and simpler design for an accelerator mass spectrometer (AMS) is needed to facilitate the continued growth of AMS applications.

SUMMARY OF THE INVENTION

The accelerator mass spectrometer of this invention utilizes a single stage air insulated accelerator (SSAMS). A negative carbon ion source is placed inside a negatively-charged high voltage terminal. The ion beam emerges from the ion source and is accelerated to moderate energy, approximately 35,000 electron volts, and is filtered by a momentum analyzer, i.e., an analyzing bending magnet, to remove unwanted ions. Reference ions such as carbon-12 are deflected and measured in an off-axis Faraday cup. Ions of mass 14 are accelerated to ground potential and passed through a gas stripper where the ions undergo charge exchange and molecular destruction. The desired isotope, carbon-14 along with fragments of the interfering molecular ions emerge from a stripper into a momentum analyzer (analyzing bending magnet) which removes all but the desired isotope ions from the beam. The ions in emerging from the analyzing magnet are further filtered by passing through an electrostatic spherical analyzer to remove ions which have undergone charge exchange while passing through the analyzing magnet. The ions remaining after the spherical analyzer are transmitted to a detector and counted.

It is an object of the present invention to provide an accelerator mass spectrometer of lower-cost, simpler operation and smaller size.

It is a further object of the present invention to provide an accelerator mass spectrometer for detecting carbon-12 to carbon-14 ratios.

It is another object of the present invention to provide an accelerator mass spectrometer utilizing an air insulated high voltage electrode.

Further objects, features and advantages of the invention will be apparent from the following detailed description when taken in conjunction with the accompanying drawings.

DESCRIPTION OF THE PREFERRED EMBODIMENTS

Figure 1:
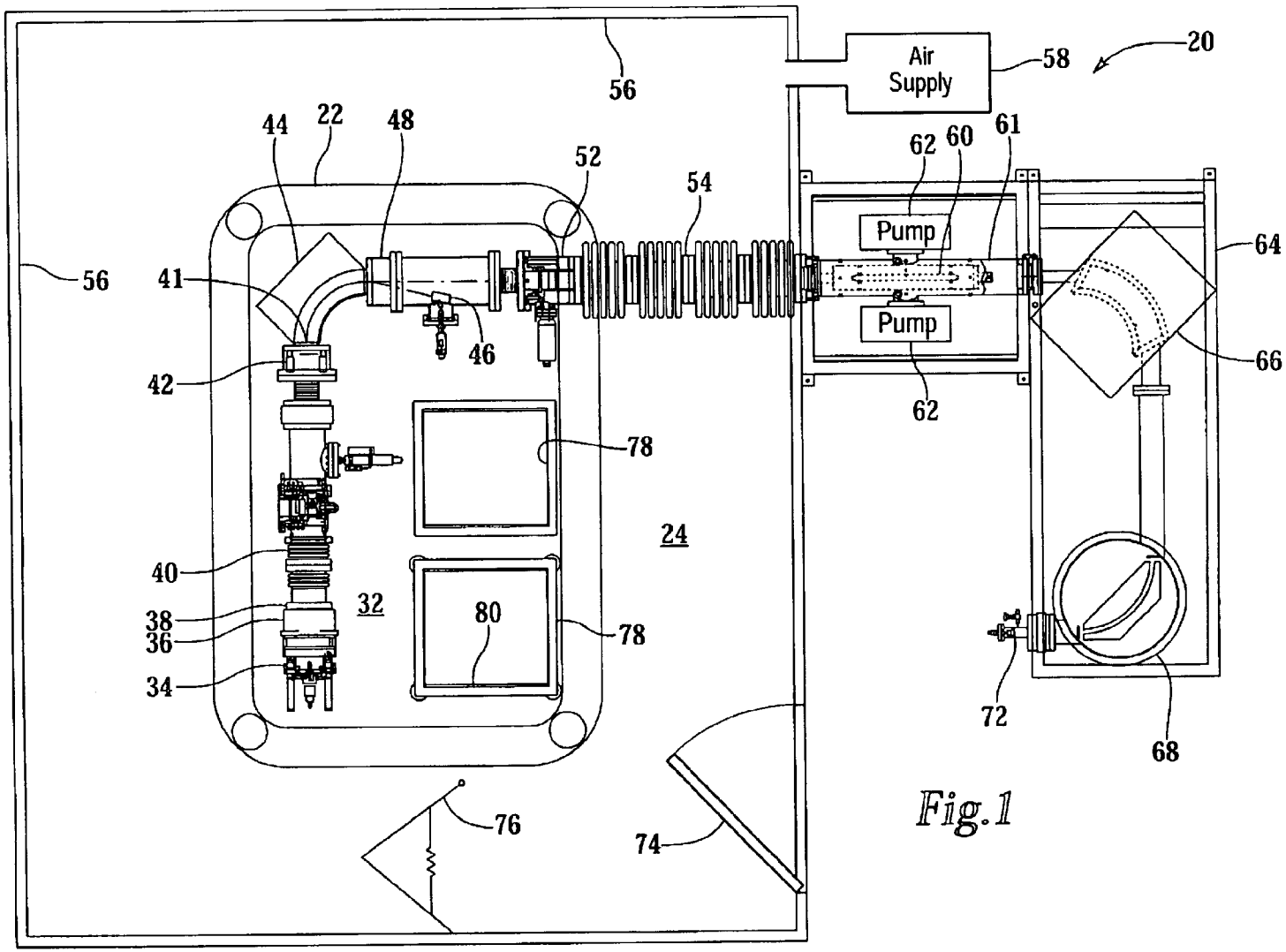
FIG. 1 is a somewhat schematic top plan view of the accelerator mass spectrometer of this invention.
Figure 2:
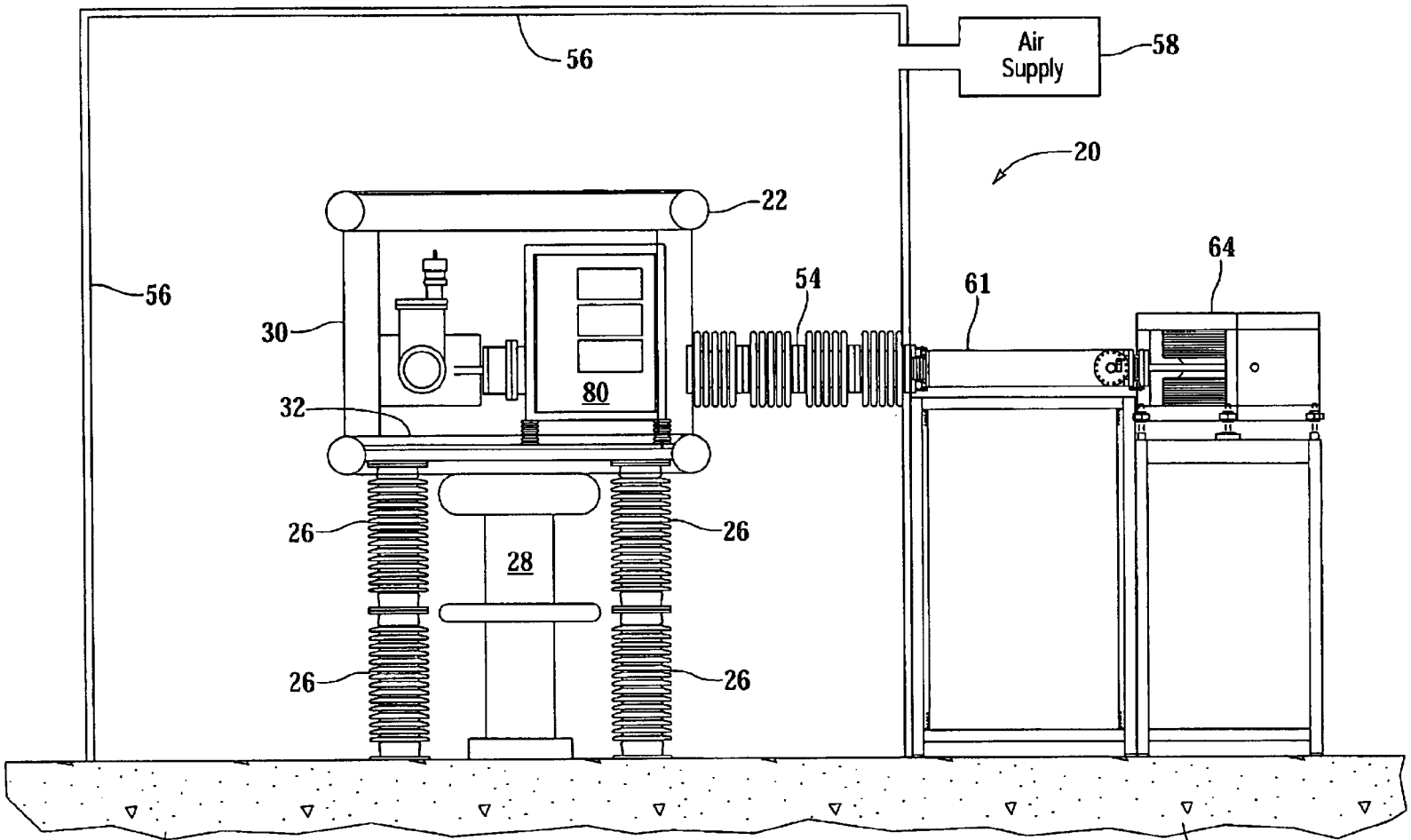
FIG. 2 is somewhat schematic side elevational view of the accelerator mass spectrometer of FIG. 1.
Figure 3:
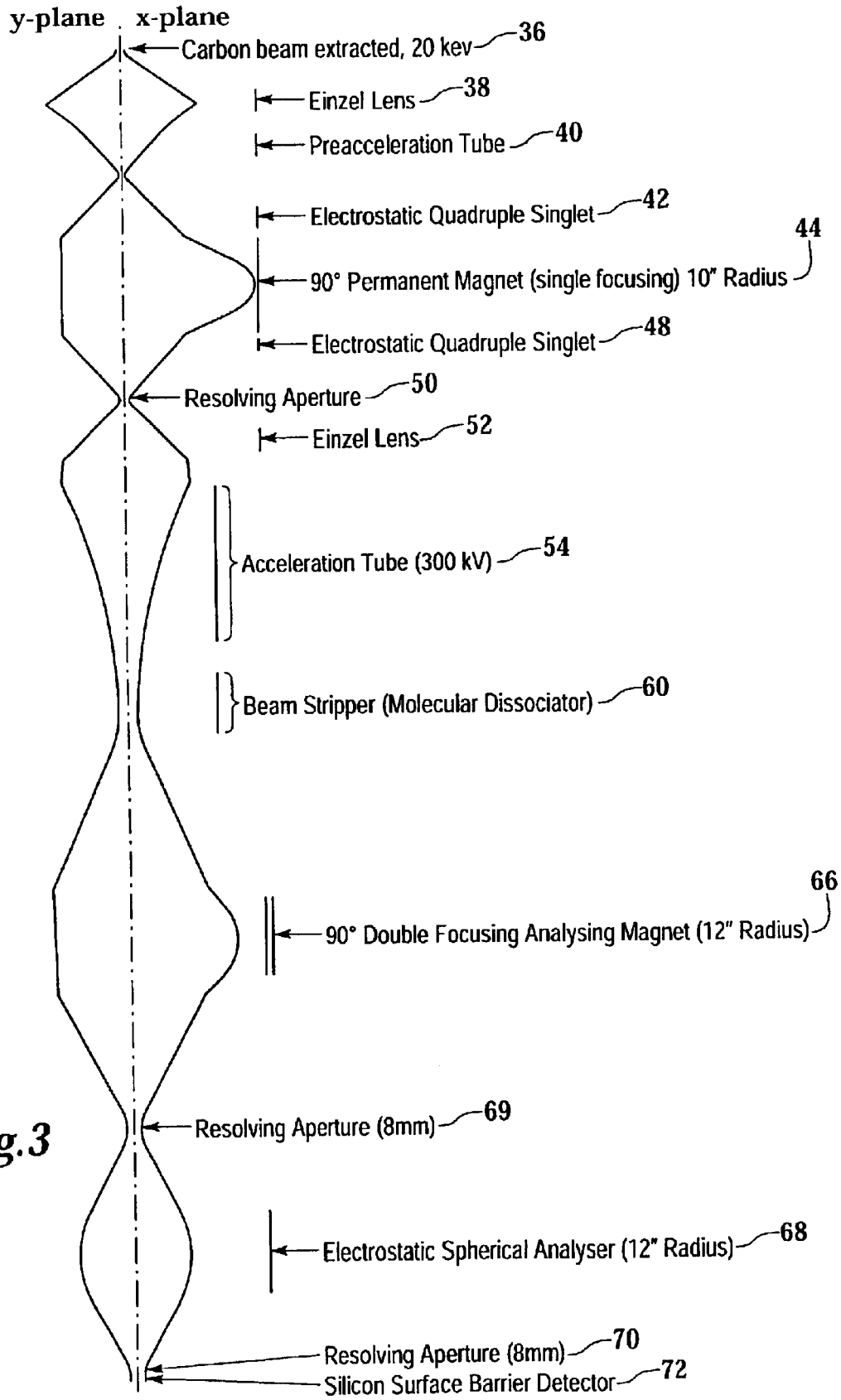
FIG. 3 is a schematic view of the beam profile in the x-axis and y-axis of the beam as it moves through the accelerator of FIG. 1.

Referring more particularly to FIGS. 1–3, wherein like numbers refer to similar parts, a Single Stage Accelerator Mass Spectrometer (SSAMS) 20 is shown in FIG. 1 and FIG. 2. The SSAMS 20 has an air insulated high voltage electrode 22 which is isolated from ground 24 by conventional high voltage ceramic insulators 26. A solid-state high voltage power supply 28 is positioned between ground 24 and the high voltage electrode 22 and raises the potential of the high voltage electrode to 300,000 volts. The high voltage electrode 22 is constructed of a steel frame 30 which supports an equipment deck 32. The equipment deck 32 is enclosed by removable metal panels (not shown) creating a Faraday cage within the high voltage electrode.

Mounted on the equipment deck 32 are a multi-sample carbon negative ion source 34, which produces $1^-$carbon ions with an energy of about six keV, followed by a beam extractor 36 with an extracting acceleration of about twelve KV which is followed by an Einzel lens 38 followed by a preacceleration tube 40 producing an additional acceleration of about twenty-two KV. The carbon ion beam 41 thus produced has an energy of about 35 keV. An electrostatic quadruple singlet 42 focuses the beam 41 into an analyzer 44 consisting of a 90-degree permanent magnet of 10 inch radius. The analyzer magnet 44 separates the negative ions contained in the beam by mass, lighter weight ions being caused to bend more than heavier ions. The dominant ions present consist of carbon-12, carbon-13, carbon-14 and various molecular isobars such as $^{13}CH$, $^{13}CH_2$, $^{12}CH_2$, and $^{12}CH$. The analyzing magnet 44 bends the molecular weight 12 particles so they are captured in a Faraday cup 46 positioned for that purpose. The Faraday cup 46 thus produces a current which is a direct measurement of the rate of molecular weight 12 particles produced by the ion source and transmitted through the analyzer. The molecular weight 12 particles are substantially all carbon-12 atoms and thus the outlet of the Faraday cup 46 corresponds to carbon-12 contained in the particle beam 41.

Molecular weight 14 particles consisting of carbon-14, $^{13}CH$, and $^{12}CH_2$, are passed through a second electrostatic quadruple singlet lens 48 followed by a resolving aperture 50 followed by a second Einzel lens 52 and are injected into a 300 kV acceleration tube 54 which extends between the high voltage electrode 22 and ground 24. A grounded cage or preferably room 56 surrounds the high voltage electrode 22 and the acceleration tube 54. The room 56 isolates the high voltage components of the SSAMS 20 from the human operator of the SSAMS for safety reasons, and allows the high voltage electrode 22 to be surrounded by air which has been conditioned to remove moisture and dust particles by an air supply unit 58. The air supply unit 58 creates a slight positive pressure within the room 56 preventing the inflow of unconditioned air into the room. By controlling moisture the breakdown resistance of the air is controlled, and by removing particles, the precipitation of dust onto the high voltage electrode 22 is prevented.

Immediately following the acceleration tube 54 the ion beam 41 passes through a gas stripper column 60 of argon gas having a density of two micrograms per square cm, along the axis of the beam 41. The stripper column causes the mass 14 ions to collide with argon atoms which breaks up the molecular isobars $^{13}CH$, and $^{12}CH_2$ so that the only remaining mass 14 ions are carbon-14 ions in the +1, +2, or +3 state. The gas stripper 60 necessarily results in gas leaking into the evacuated beam transport pipe 61. Where stripping occurs at the high voltage electrode, such as typically done in the tandem accelerator, removal of gas is complicated by the necessity of locating the pumping equipment within the high voltage electrode. In the SSAMS 20 of this invention the stripping column 60 is located at ground potential allowing vacuum pumps 62 located on either side of the stripping column 60 to easily remove the gas injected into the beam transport 61.

A second analyzer 64 receives the beam 41 as it leaves the gas stripping column 60 and is composed of an electromagnetic bending magnet 66 and an electrostatic spherical analyzer 68 separated by a resolving aperture 69. The bending magnet 66 alone is not sufficient to separate the carbon-14 atoms from the other atomic species because lighter weight ions can be neutralized by charge exchange just as they reach the same amount of deflection as the carbon-14 atoms experiences and thus these neutral particles follow the same trajectory as the carbon-14 atoms and, in the absence of an additional analyzing component, strike the detector. Utilizing an electrostatic spherical analyzer 68 which is of the same radius as the electromagnetic bending magnet 66 produces an achromatic lens system which reduces the dispersion caused by the variation in particle energy produced by energy loss in the stripping column 60.

Following the spherical analyzer, the beam passes through a final resolving aperture 70 into a silicon surface barrier detector 72 which counts individual carbon-14 ions. Typically the bending magnet 66 and the electrostatic spherical analyzer 68 are adjusted so that carbon-$14^{+1}$ ions impact the detector 72. Carbon-$14^{+1}$ ions predominate because of the relatively low beam energy, approximately 335 keV, making up about 50 percent of the carbon-14 ions present in the stripped beam.

An important feature of the SSAMS 20 is the multi-sample carbon source 34. Such multi-sample sources are well known in the prior art, and may be based on solid or gaseous samples as taught in U.S. Pat. No. 5,644,130 to James E. Raatz which is incorporated herein by reference. The multi-sample carbon source 34 when combined with the beam extractor 36 forms a multiply selectable negative carbon ion source. A multiple cathode ion source in a 40 or a 134-sample configuration is available from National Electrostatic Corporation of Middleton, Wis. The multi-sample carbon source 34 allows unknown samples to be compared against known samples. The known samples of particular use are carbon derived from modern biological materials, and old carbon samples derived from geologically old carbon sources, such as coal which contains essentially no carbon-14. The old carbon allows calibrations of the SSAMS 20 to be sure that the stripper is adequately breaking down molecular isobars and that the second analyzer is removing all non carbon-14 particles. On the other hand, modem carbon has a known ratio between carbon-12 and carbon-14 which can be used to calibrate the relationship between the current produced by the carbon-12 beam in the Faraday cup 46, and the carbon-14 as detected by the silicon surface barrier detector 72. Thus the errors due to a certain amount of the carbon-12 which forms hydrogen compounds not reaching the Faraday cup 46, or losses of carbon-14 atoms due to the fact the stripping process produces only about 50 percent carbon-$14^{+1}$ ions, can be substantially eliminated. By repeatedly analyzing the known samples between unknown samples the SSAMS 20 has produced sample measurement precision of better than one percent with a background of better than 40,000 years.

It will be understood by those skilled in the art of electrostatic accelerator and beam optic design that it will be useful or desirable to place additional Faraday cup and beam monitors along the beam path through the evacuated beam transport pipe 61. In particular, an adjustable Faraday cup and beam monitor may be placed between the electromagnetic bending magnet 66 and the electrostatic spherical analyzer 68. Similarly, a beam monitor and Faraday cup may be placed after the pre-acceleration tube 40, and at other places as those skilled in the art may find useful, in setting up and calibrating the SSAMS 20. In addition, vacuum pumps will be placed within the high voltage electrode 22 and in the evacuated beam transport pipe 61.

The use of an air insulated high voltage electrode 22 allows ready access to the multi-sample carbon ion source 34. The high voltage electrode 22 is grounded, and a door 74 connected to a safety interlock 76 which also grounds the electrode 22, allows access to the high voltage electrode 22. The multi-sample carbon ion source 34 contained within the electrode 22 is accessed by removing metal panels (not shown) which cover the vertical faces of the high voltage electrode 22. In a typical accelerator mass spectrometer, beam currents are substancially higher than in the SSAMS 20 due to the practice of continuously accelerating carbon-13 ions and periodically accelerating carbon-12 ions. The SSAMS 20, by accelerating only mass-14 ions, reduces beam current and the undesirable production of x-rays which can result from higher beam currents. The relatively large easily accessible high voltage electrode allows the positioning of electronic controllers (not shown) within equipment boxes 78, within the high voltage electrode 22. The electronic control box 80 which controls and supplies voltage to the ion source 34 may be held at about 35 kV voltage above that of the high voltage electrode.

Electrical power to operate the various pieces of equipment located within the high voltage electrode are supplied by a pair of isolation transformers (not shown) connected in series which supply conventional wall plug power to the electronic controllers and equipment located on the equipment deck 32. Control commands are communicated by means of optical fiber.

The SSAMS 20 of this invention may be used for the detection of other atomic isotopes. The applicability of the SSAMS 20 design to other isotopes depends on the particular isotope being considered. For many isotopes such as chlorine, very high beam energies are required so the isotope of interest can be distinguished from isotopes having the same mass but different atomic numbers. However, for some isotopes such as tritium a relatively low acceleration voltage such as supplied by the air-insulated accelerator of this invention can be effective. Of course, for various other ions the individual beam handling components such as the beam optics, including the first beam bending magnet, will need to be configured to the particular isotope of interest.

The essential components for any SSAMS include a high voltage air insulated electrode having a potential of less than 500 kilovolts, preferably less than 300 kilovolts, and located at the high voltage electrode an ion source which may be remotely controlled or automatically controlled to produce ions from multiple samples sequentially in time. Also located at the high voltage electrode is a mass spectrometer consisting of an analyzer which breaks ions produced by the ion source into at least two species on the basis of mass. One of the two species of ions is directed into the Faraday cup to produce a reference current proportional to the rate of collection of the one ion. The mass spectrometer injecting the second of the two ion species into an acceleration column. A gas stripper will preferably be used, because its mass density can be readily adjusted, although thin foil stripping could be used. The stripper is followed by an analyzer and finally a particle detector.

Preferably the high voltage electrode SSAMS will be located within a safety cage or room which is supplied with conditioned air, the entrance of the room being connected with a safety interlock to ground the high voltage electrode before or as the door is opened. Preferably wall socket power will be transmitted to the high voltage electrode deck through one or more isolation transformers arranged in series, and the high voltage electrode deck will be supplied with a solid-state high voltage source.

It should be understood that although air insulated electrodes of more than one million volts are known, because of their size, space and cost limitations, it is desirable that the high voltage electrode be as low voltage as possible, and that high voltage electrodes above about 500 kilovolts will not be economically desirable.

It should be understood that where the invention is defined with respect to ground, ground potential would not necessarily be equivalent to an earth ground, but may vary by such small potential as does not interfere with the practicality and simplicity of the accelerator described herein.

It should be understood that the term "single stage electrostatic accelerator" means that the ion beam used in the mass spectrometer passes only once between the high-voltage electrode and ground.

Figure 4:
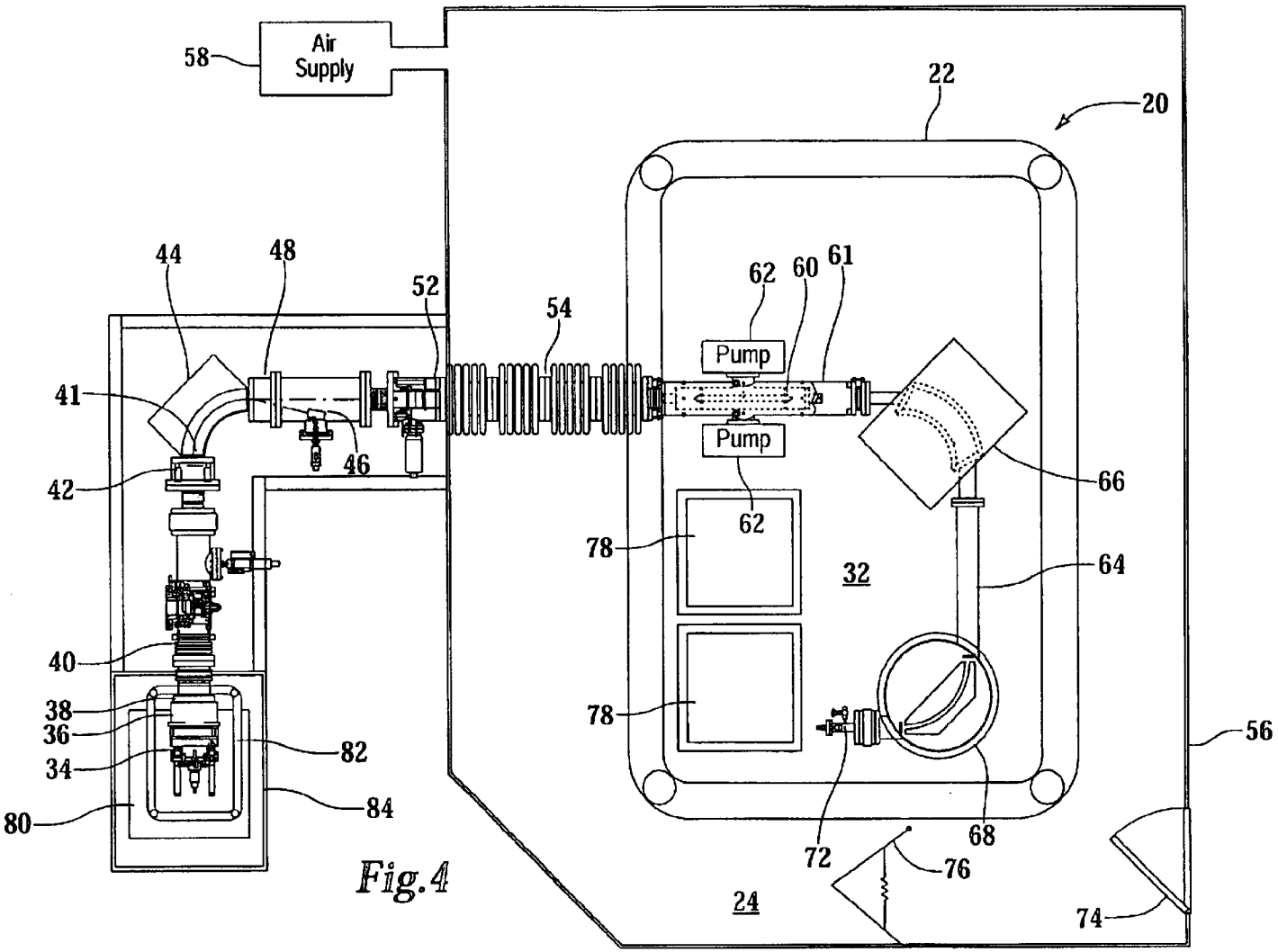
FIG. 4 is a somewhat schematic top plan view of an alternative embodiment of the accelerator mass spectrometer of this invention.
Figure 5:
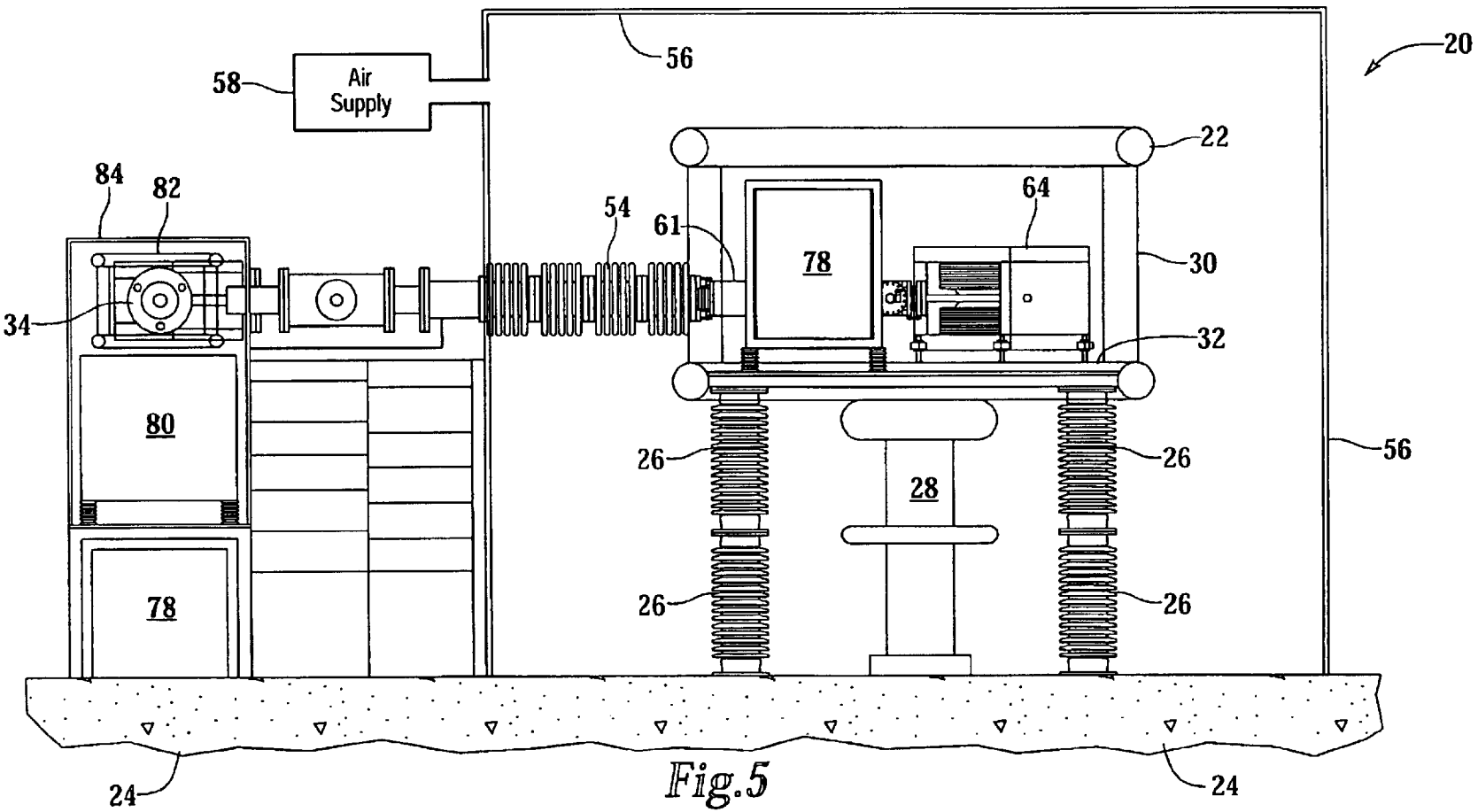
FIG. 5 is a somewhat schematic side elevational view of the accelerator mass spectrometer of FIG. 4.

It should be understood that the location of the SSAMS components could be reversed so that the ion source 34 within a separate lower voltage electrode 82, the pre-acceleration tube 40, and the permanent magnet 44, together with the Faraday cup 46, could all be located at ground, and the gas stripping column 60, having analyzing magnet 66, electrostatic spherical analyzer 68 and the silicon surface barrier detector 72, could all be located within the high-voltage electrode as shown in FIGS. 4 and 5, wherein like reference numbers refer to like parts. The ion source when positioned at ground must still be raised to approximately 35,000 volts requiring a voltage isolation chamber 84, and the additional power and control which would be necessary at the high-voltage electrode, to handle the electromagnet and data collection at the detector. However the invention is not intended to be limited to the particular configuration shown and described but only by the claims.

It should also be understood that the description of the ion source, the ion filter, and the ion accelerator, as being within the high voltage electrode, is defined to include positioning of these component parts such that they are substantially included within the Faraday shield defining the high voltage electrode, or are positioned within a Faraday cage of a second higher voltage electrode mounted on the high voltage electrode.

It is understood that the invention is not limited to the particular construction and arrangement of parts herein illustrated and described, but embraces all such modified forms thereof as come within the scope of the following claims.

We claim:

1. An accelerator mass spectrometer comprising:

a single stage electrostatic accelerator having an air insulated negative high voltage electrode, and an acceleration column, extending between the high voltage electrode and a ground potential;

a multiply selectable negative carbon ion source located within the high voltage electrode, capable of producing negative ions from a plurality of samples;

an ion filter located within the high voltage electrode positioned to receive and to separate by mass, negative ions from the multiply selectable negative carbon ion source, the ion filter arranged to inject molecular weight 14 ions into the acceleration column;

at least one Faraday cup positioned to receive molecular weight 12 ions;

an ion stripper at the ground potential, in ion beam receiving relation with the acceleration column;

an ion filter at ground potential, in ion receiving relation with the ion stripper;

an ion detector at ground potential in ion receiving relation with the ion filter.

2. The accelerator mass spectrometer of claim 1 wherein the ion filter located within the high voltage electrode comprises a bending magnet.

3. The accelerator mass spectrometer of claim 2 wherein the bending magnet is a permanent magnet.

4. The accelerator mass spectrometer of claim 1 wherein the ion stripper is of the type employing rarefied gas.

5. The acceleration mass spectrometer of claim 1 wherein the ion filter at ground potential comprises an analyzing bending magnet, followed by an electrostatic analyzer.

6. The acceleration mass spectrometer of claim 5 wherein the electrostatic analyzer is of the spherical type.

7. The acceleration mass spectrometer of claim 1 further comprising an acceleration potential between the ion source and the ion filter located within the high voltage electrode.

8. The acceleration mass spectrometer of claim 1 further comprising a Faraday cup arranged to receive and measure mass-12 ions from the ion filter located within the high voltage electrode.

9. The acceleration mass spectrometer of claim 1 further comprising a grounded enclosure about the high voltage electrode and the acceleration column.

10. The accelerator mass spectrometer of claim 9 further comprising a source of air which has been conditioned to remove moisture and dust particles connected to the enclosure.

11. The acceleration mass spectrometer of claim 1 wherein the ion detector is of the silicon surface barrier detector type.

12. The acceleration mass spectrometer of claim 1 wherein the high voltage electrode has a potential with respect to the ground of approximately 500,000 volts or less.

13. The acceleration mass spectrometer of claim 12 wherein the high voltage electrode has a potential with respect to the ground of approximately 300,000 volts or less.

14. The acceleration mass spectrometer of claim 1 wherein the ion source is at a potential of approximately 35,000 volts with respect to the high voltage electrode so the total energy of the ions produced by the ion source when entering the stripper is approximately 335,000 electron volts.

15. A method of performing mass spectrometry comprising the steps of:

selecting one of a plurality of carbon sources and generating negative carbon ions from said one of said plurality of carbon sources, the generation of carbon ions being performed within a high voltage air insulated electrode which is maintained at less than about 500,000 volts above a ground potential;

employing an analyzer mounted within the high voltage air insulated electrode to separate mass 14 , and mass 12 ions from the generated carbon ions and capturing in a Faraday cup the mass 12 ions and measuring a first current of mass 12 ions;

injecting the mass 14 ions into an accelerator tube and accelerating the mass 14 ions to the ground potential;

passing the accelerated mass 14 ions through a gas stripping column, having a cross-sectional density sufficient to destroy substantially all mass 14 ions comprised of molecular isobars;

employing a second analyzer following the gas stripping column to separate mass 14 ions; and detecting the mass 14 ions.

16. The method of claim 15 further comprising the steps of:

selecting an old carbon source which contains essentially no carbon-14 from a plurality of carbon sources;

adjusting the cross-sectional density in the stripping column until essentially no mass 14 ions are detected;

selecting a modem carbon source which contains a known mass 12 to mass 14 ratio from the plurality of carbon sources and establishing a ratio between the first current and the rate of mass 14 ion detection;

selecting an unknown carbon source from the plurality of carbon sources and measuring a ratio between the first current and the rate of mass 14 ion detection, and calculating a normalized ratio for the unknown carbon sources based on the ratio established for the modem carbon source.

17. An accelerator mass spectrometer comprising:

a single stage electrostatic accelerator having an air insulated negative high voltage electrode, and an acceleration column, extending between the high voltage electrode and a ground potential;

a multiply selectable negative ion source located within the high voltage electrode;

an ion filter located within the high voltage electrode positioned to receive and to separate by mass, ions from the multiply selectable ion source, the ion filter arranged to inject a first selected molecular weight into the acceleration column;

a Faraday cup positioned after the ion filter and positioned to receive at least ions of a second selected type, the Faraday cup producing a current proportional to the number ions of the second selected type;

an ion stripper at the ground potential, in ion beam receiving relation with the acceleration column;

an ion filter at ground potential, in ion receiving relation with the ion stripper;

an ion detector at ground potential in ion receiving relation with the ion filter.

18. The accelerator mass spectrometer of claim 17 wherein the ion filter located within the high voltage electrode comprises a permanent bending magnet.

19. The accelerator mass spectrometer of claim 17 wherein the ion stripper is of the type employing rarefied gas.

20. The acceleration mass spectrometer of claim 17 wherein the ion filter at ground potential comprises an achromatic lens system comprising a bending magnet, followed by an electrostatic spherical analyzer.

21. An accelerator mass spectrometer comprising:

a single stage electrostatic accelerator having an air insulated high voltage electrode, and an acceleration column extending between the high voltage electrode and a ground potential;

a multiply selectable negative ion source column producing multiple isotopic ions of a selected atomic number from a multiplicity of samples;

at least one Faraday cup positioned to receive isotopic ions of a first selected mass of the selected atomic number, positioned before the acceleration column;

an ion stripper in ion beam receiving relation with the acceleration column;

an ion detector downstream of the ion stripper;

wherein multiple isotopic ions of the selected atomic number from the multiply selectable ion source pass through a first filter which directs isotopic ions of a second selected mass of the selected atomic number into the acceleration column, and to direct the isotopic ions of the first selected mass of the selected atomic number into the Faraday cup, the second selected ions passing through the ion stripper and passing through a second filter which passes only ions of the second selected mass to the ion detector, and wherein one of said first filter and the second filter is located at the high voltage electrode, and wherein at least one of said first filter and second filter is located at the ground potential.

22. A method of performing mass spectrometry employing a single stage accelerator comprising the steps of:

selecting one of a plurality of negative ion sources and generating ions from said one of said plurality of ion sources;

employing an analyzer to separate ions of different masses including a first selected mass and a second selected mass;

injecting the first selected mass ions into an accelerator tube and accelerating the first selected mass ions between ground potential and an air insulated high voltage electrode;

passing the first selected mass ions through a gas stripping column, having a cross-sectional density sufficient to destroy substantially all first selected mass ions comprised of molecular isobars;

employing a second analyzer following the gas stripping column to separate first selected mass ions; and detecting the first selected mass ions with the detector.

23. An accelerator mass spectrometer comprising:

a single stage electrostatic accelerator having an air insulated high voltage electrode and an acceleration column extending between the high voltage electrode and a ground potential;

a multiply selectable negative carbon ion source column at ground potential and having a lower voltage electrode capable of raising the ion source potential, said ion source being capable of producing negative ions from a plurality of samples;

an ion filter located at ground potential positioned to receive and to separate by mass, negative ions from the multiply selectable negative carbon ion source, the ion filter arranged to inject molecular weight 14 ions into the acceleration column;

at least one Faraday cup positioned to receive molecular weight 12 ions;

an ion stripper at the high voltage electrode, in ion beam receiving relation with the acceleration column;

an ion detector at the high voltage electrode in ion receiving relation with the ion filter.

24. The accelerator mass spectrometer of claim 23 wherein the ion stripper is of the type employing rarefied gas.

25. The acceleration mass spectrometer of claim 23 wherein the ion filter at the high voltage electrode comprises an analyzing bending magnet, followed by an electrostatic analyzer.

26. The acceleration mass spectrometer of claim 25 wherein the electrostatic analyzer is of the spherical type.

27. The acceleration mass spectrometer of claim 23 further comprising an acceleration potential between the ion source and the ion filter.

28. The acceleration mass spectrometer of claim 23 further comprising a Faraday cup arranged to receive and measure mass-12 ions from the ion filter located at ground potential.

29. The acceleration mass spectrometer of claim 23 further comprising a grounded enclosure about the high voltage electrode and the acceleration column.

30. The accelerator mass spectrometer of claim 29 further comprising a source of air which has been conditioned to remove moisture and dust particles connected to the enclosure.

31. The acceleration mass spectrometer of claim 23 wherein the ion detector is of the silicon surface barrier detector type.

32. The acceleration mass spectrometer of claim 23 wherein the high voltage electrode has a potential with respect to the ground of approximately 500,000 volts or less.

33. The acceleration mass spectrometer of claim 32 wherein the high voltage electrode has a potential with respect to the ground of approximately 300,000 volts or less.

34. The acceleration mass spectrometer of claim 23 wherein the ion source is at a potential of approximately 35,000 volts with respect to the ground.

35. The accelerator mass spectrometer of claim 23 wherein the ion filter located at ground potential comprises a bending magnet.

36. An accelerator mass spectrometer comprising:

a single stage electrostatic accelerator having an air insulated high voltage electrode, and an acceleration column extending between the high voltage electrode and a ground potential;

a multiply selectable negative ion source located at the ground potential and having a lower voltage electrode;

an ion filter located at the ground potential positioned to receive and to separate by mass, ions from the multiply selectable ion source, the ion filter arranged to inject a first selected molecular weight into the acceleration column;

a Faraday cup positioned after the ion filter and positioned to receive at least ions of a second selected type, the Faraday cup producing a current proportional to the number of ions of the second selected type;

an ion stripper at the high voltage electrode in ion beam receiving relation with the acceleration column;

an ion filter at the high voltage electrode in ion receiving relation with the ion stripper;

an ion detector at the high voltage electrode in ion receiving relation with the ion filter.

37. The accelerator mass spectrometer of claim 36 wherein the ion filter located at the ground potential comprises a bending magnet.

38. The accelerator mass spectrometer of claim 36 wherein the ion stripper is of the type employing rarefied gas.

39. The acceleration mass spectrometer of claim 17 wherein the ion filter at the high voltage electrode comprises an achromatic lens system comprising a bending magnet, followed by an electrostatic spherical analyzer.

* * * * *